US005366132A

United States Patent [19]

Simonelli

[11] Patent Number: 5,366,132

[45] Date of Patent: Nov. 22, 1994

[54] PORTABLE FASTENER DRIVING DEVICE WITH INADVERTENT IMPACT ACTIVATION PREVENTION

[75] Inventor: David J. Simonelli, Coventry, R.I.

[73] Assignee: Stanley-Bostitch, Inc., East Greenwich, R.I.

[21] Appl. No.: 45,733

[22] Filed: Apr. 14, 1993

[51] Int. Cl.[5] ..... B25C 1/04

[52] U.S. Cl. ..... 227/8; 227/130

[58] Field of Search ..... 227/8, 120, 130

[56] References Cited

U.S. PATENT DOCUMENTS

| | | | |
|---|---|---|---|
| 3,708,096 | 1/1973 | Burke, Jr. . | |
| 3,784,077 | 1/1974 | Burke, Jr. et al. . | |
| 4,039,113 | 8/1977 | Males . | |
| 4,509,668 | 4/1985 | Klaus et al. | 227/8 |
| 4,629,106 | 12/1986 | Howard et al. | 227/8 |
| 4,721,170 | 1/1988 | Rees | 227/8 |
| 5,083,694 | 1/1992 | Lemos . | |
| 5,137,197 | 8/1992 | Bauer | 227/8 |
| 5,174,485 | 12/1992 | Meyer | 227/8 |
| 5,193,730 | 3/1993 | Tanaka et al. | 227/8 |
| 5,219,110 | 6/1993 | Mukoyama | 227/8 |

*Primary Examiner*—Scott A. Smith
*Attorney, Agent, or Firm*—Cushman, Darby & Cushman

[57] ABSTRACT

A fastener driving device including a housing having a power operated drive therein. A fastener driving element is slidably mounted in a drive track and operatively connected with the power operated drive so as to drive a leading fastener fed into the drive track from a magazine outwardly of the drive track and into a workpiece during a drive stroke of the drive. An actuating mechanism includes a contact trip element and a trigger member and is operable to actuate the power operated drive in response to the movement of the contact trip element and the trigger member into operative positions. The actuating mechanism is such that an unwanted actuation of the power operated drive will occur in response to an inadvertent impact of the housing with a foreign object during an upward manual movement of the housing while the operator is exerting digital pressure on the trigger member by the continued upward movement of the contact trip from the inoperative position thereof into the operative position. An actuation preventing mechanism is provided for preventing an unwanted actuation of the power operated drive in response to an inadvertent impact of the housing with a foreign object during an upward manual movement of the housing.

14 Claims, 2 Drawing Sheets

PORTABLE FASTENER DRIVING DEVICE WITH INADVERTENT IMPACT ACTIVATION PREVENTION

This invention relates to fastener driving tools and more particularly to tools of this type adapted to be used portably, in which inadvertent actuation of the device caused by accidentally striking the tool into a foreign object is prevented.

The art relating to portable power actuated fastener driving devices is highly developed. One feature of these devices which contributes to their acceptability is that they are portable and capable of being operated while held in the hand of an operator. This feature of portability also gives rise to the possibility of inadvertent actuation resulting in the discharge of a fastener other than into the workpiece. In order to reduce this possibility, it has been common practice to build into such devices a so-called contact trip element in addition to the finger actuated trigger. The contact trip element is mounted on the device in a position adjacent to the nosepiece so as to normally extend outwardly beyond the discharge end of the fastener drive track. Thus, when the nosepiece of the device is moved into engagement with the workpiece, the contact trip is moved from its normally inoperative position into an operative position.

In most instances, the work engaged movement of the contact trip into its operative position is utilized as an essential action along with finger actuation of the trigger into its operative position to achieve actuation without regard to the sequence in which the two movements are accomplished. This concomitant type of response is regarded to be particularly desirable in that it provides the operator with two basic modes of operation which allow for high speed operation of the device involving rapid, repetitive actuations. One rapid repetitive mode is the so-called "drag firing" mode in which the operator initially positions the device into engagement with the workpiece without pressing the trigger, and then drags the device along the workpiece in continuous contact therewith so as to maintain the contact trip in its operative position. By successively pressing and releasing the trigger a fastener is driven during each movement of the trigger into its operative position. The present invention, however, is not directed to this "drag firing" mode.

Another rapid repetitive mode of operation is the so-called "bump firing" mode where the operator keeps the trigger in its operative position by continuous digital pressure. By bumping the device along the workpiece a fastener is driven during each movement of the contact trip into its operative position with each successive contact of the device with the workpiece.

While all of these high speed modes of operation are desirable from a standpoint of increased productivity, they do require that the operator exercise care to avoid inadvertent or unwanted actuations of the tool. One possibility for an inadvertent actuation occurs when an operator, holding the device in his hand with the trigger pressed, accidentally impacts an upper portion of the housing of the tool into an foreign object. This impact, if sufficiently hard, can cause the contact trip to move into its operative position due to the housing remaining stationary following the impact and the contact trip continuing to travel toward the operative position due to impulse forces created by the impact. Moreover, if at the time the operator also has his finger on the trigger holding it in its operative position, an inadvertent firing can take place. Since the nosepiece is not in engagement with a workpiece, the inadvertent firing results in a fastener being ejected into the air, thus creating an undesirable safety hazard.

However, because the contact trip is moved into the operative position by the impulse force only momentarily, it has heretofore been the practice to build into the drive system a delay in the commencement of the drive stroke by the power operated means in response to the actuating movements. This delay avoids the power drive means from being moved through its drive stroke and driving a fastener into an object other than the workpiece. This delay, however, has the major disadvantage of slowing down the device so that the number of fasteners that can be driven into a workpiece in a given period of time is reduced. The delay also causes the further disadvantage of reducing the force produced by the power operated means for driving a fastener into the workpiece, particularly for pneumatically powered devices.

It is generally recognized that the chances of inadvertent action, including those due to an impact might be prevented by providing an actuating mechanism which requires the operator to sequentially move first the contact trip and then the trigger to accomplish the actuation. The safety aspects of sequential actuating mechanisms are well known. However, in some instances the sequential operation is obtained by releasably locking the trigger in its normal inoperative position against movement into its operative position by digital pressure alone and by utilizing the movement of the contact trip into its operative position to release or unlock the trigger. Under these circumstances, if the operator is pressing on the locked out trigger when the impact occurs an unwanted firing can take place.

As previously noted, these instances occur in situations where the operator is applying digital pressure to the trigger and the contact trip is inadvertently actuated when the housing is impacted by a foreign object during an upward movement of the housing. With a sequential mechanism, a similar accidental actuation can occur any time the operator is holding the device and applying digital pressure to the locked out trigger. As previously noted, the possibility of inadvertent actuation necessitates delaying the drive stroke of the power operated means. Consequently, there exists a need to provide a device which can be operated at optimum speeds and at full power, while still preventing inadvertent impact actuation of the type described.

It is an object of the present invention to fulfill the needs expressed above. In accordance with the principles of the present invention, this objective is achieved by providing a fastener driving device which comprises a housing having a handle portion enabling a user to manually operate the device in portable fashion and a drive portion disposed forwardly of the handle portion. Power operated drive is provided in the housing drive portion actuatable to be moved through successive operating cycles each of which includes a drive stroke and a return stroke. The housing also carries a nosepiece and magazine assembly which includes structure defining an elongated drive track and a feed track leading laterally into the drive track. Within the drive track is slidably mounted a fastener driving element which is operatively connected with the power operated drive so as to drive a leading fastener fed into the drive track from the feed track outwardly of the drive track and into a workpiece during the drive stroke of the power operated drive. An actuating mechanism includes a contact trip element mounted for movement adjacent the nosepiece for movement from an inoperative position to an operative position when the nosepiece is normally moved into engagement with a workpiece and a trigger member mounted on the housing adjacent the handle portion for movement by digital pressure from an inoperative position into an operative position. The actuating mechanism is operable to actuate the power operated drive to move through one operative cycle in response to the movement of the contact trip element and the trigger member into their operative positions. The actuating mechanism is such that an unwanted actuation of the power operated drive will occur in response to an inadvertent impact of the housing with a foreign object during an upward manual movement of the housing while the operator is exerting digital pressure on the trigger member by the continued upward movement of the contact trip from the inoperative position thereof into the operative position. An actuation preventing mechanism is provided for preventing an unwanted actuation of the power operated drive in response to an inadvertent impact of the housing with a foreign object during an upward manual movement of the housing.

A further object of the invention is the provision of a fastener driving device having an impulse actuated contact trip lock-out mechanism of the type described which is simple in construction, effective in operation and economical to manufacture.

These and other objects of the present invention will become more apparent during the course of the following detailed description and appended claims.

The invention may best be understood with reference to the accompanying drawings, wherein an illustrative embodiment is shown.

Figure 1:
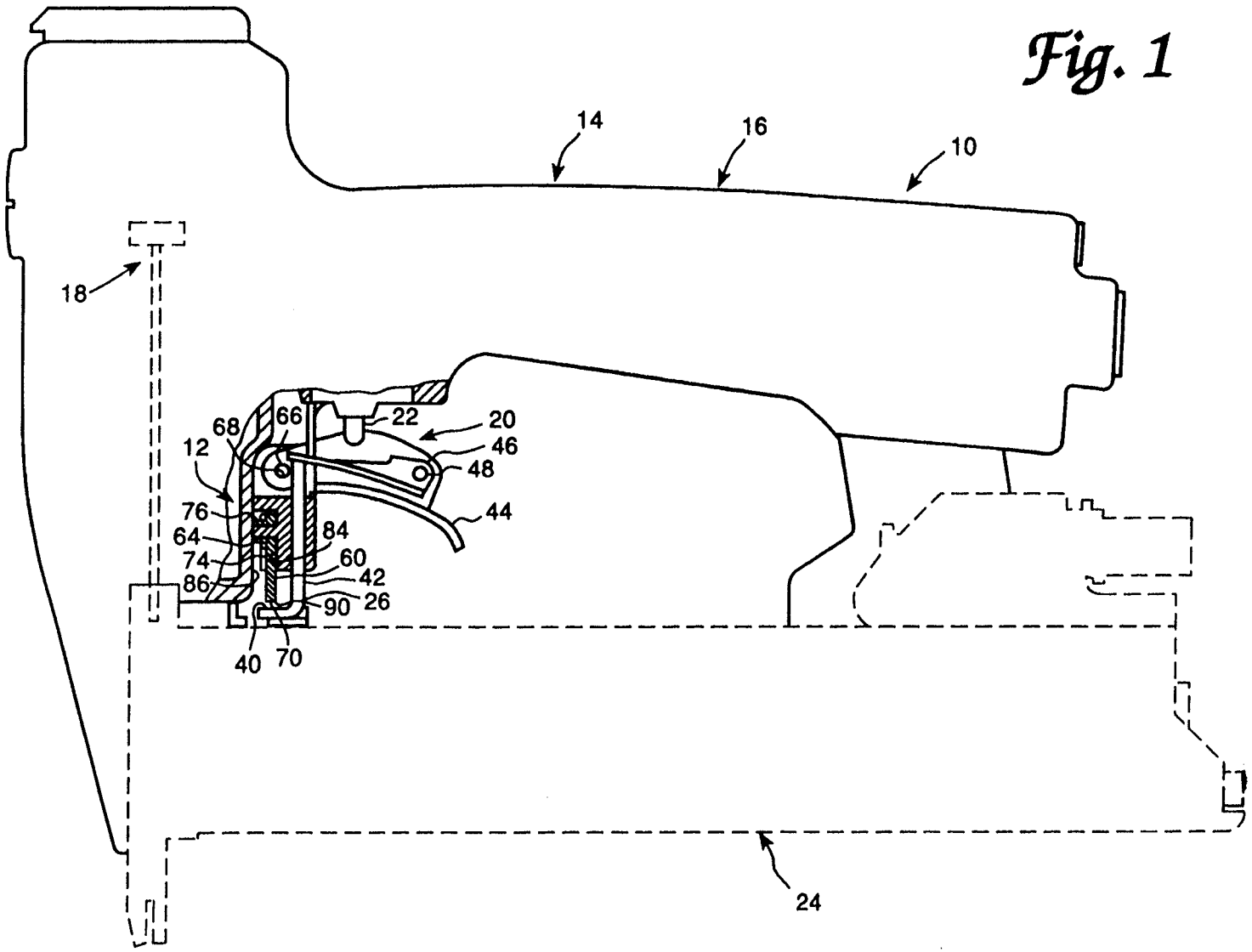
FIG. 1 is vertical fragmentary sectional view of a fastener driving tool embodying the principles of the present invention, showing the position of the parts in a normal in-operative position.
Figure 2:
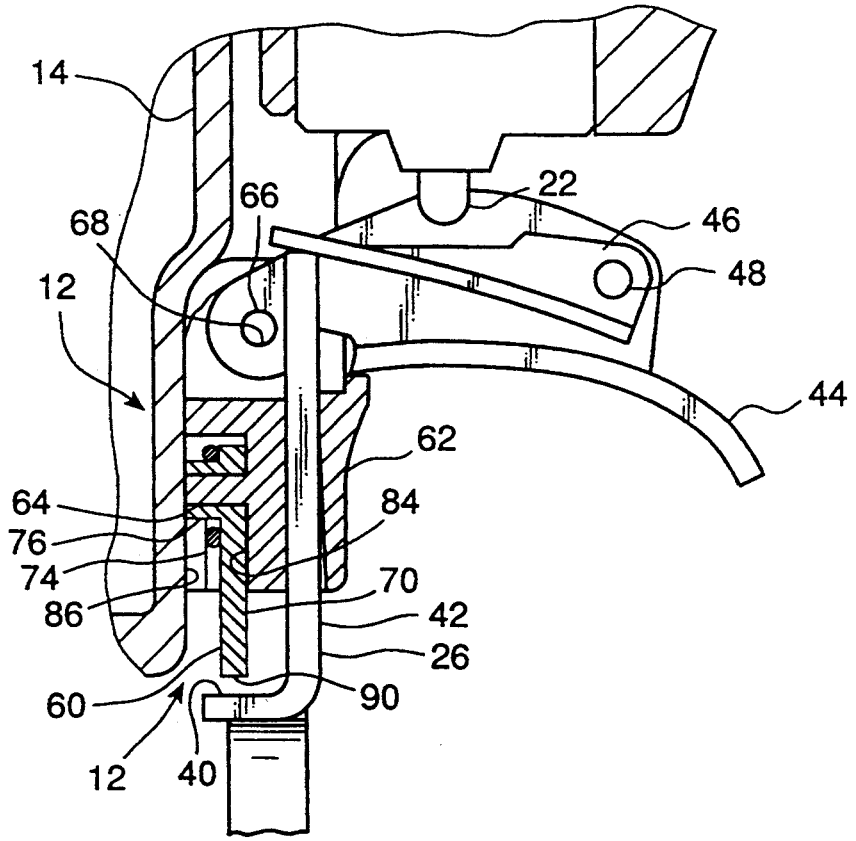
FIG. 2 is an enlarged fragmentary vertical sectional view of the impulse actuated contact trip lock-out mechanism of the present invention showing the parts thereof in their normal in-operative position.
Figure 3:
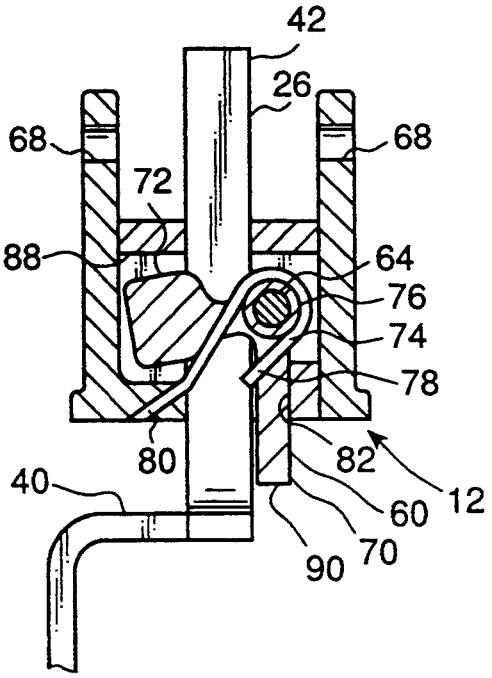
FIG. 3 is a cross-sectional view taken along line 3—3 of FIG. 1, showing the position of the parts in their normal in-operative position.
Figure 4:
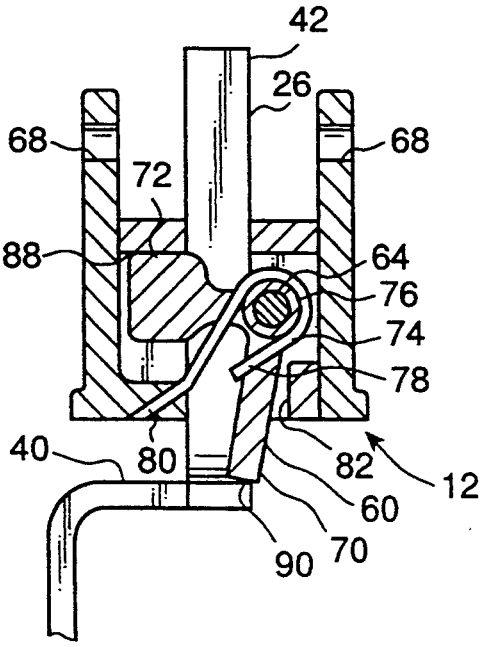
FIG. 4 is a view similar to FIG. 3 when the impulse actuated contact trip lock-out mechanism has been actuated and moved preventing manual actuation of the manual actuating mechanism.

Referring now more particularly to the drawings, there is shown in FIGS. 1–3 thereof a fastener driving device, generally indicated at 10, embodying the principles of the present invention. In the drawings, the tool is shown oriented so as to drive a fastener vertically downwardly into a horizontal work piece. It will be understood, however, that the apparatus is capable of driving a fastener into work pieces oriented in position other than the horizontal. For convenience, the apparatus will be described in relation to the orientation illustrated, consequently terms such as "horizontal", "vertical", "above", "below", "forward", "rearward", etc. as used herein are to be construed in a relative sense.

The device 10 shown may assume any conventional construction, however, the device 10 is particularly suitable for use with an impulse actuated contact trip lock-out mechanism, generally indicated at 12, embodying the principles of the present invention. The particular device 10, except for the impulse actuated contact trip lock-out mechanism 12, having a sequential type actuation is disclosed in detail in U.S. Pat. No. 5,083,694 and a device having concomitant type actuation is disclosed in detail in U.S. Pat. No. 3,784,077. While it is believed that the details of construction of the device 10 are not necessary to an understanding of the present invention, the disclosures of the above applications are hereby incorporated by reference into the present specification.

For the present purposes, it should be sufficient to note that the device 10 includes the usual housing, generally indicated at 14, providing a handle, generally indicated at 16, shaped to be grasped by the operator. Mounted within the housing 14 in conventional fashion is a pneumatically actuated fastener driving means in the form of a piston and fastener driving element indicated in dotted lines at 18 in FIG. 1. It will be understood that any type of pneumatic system may be utilized, as for example, those shown in U.S. Pat. Nos. 3,708,096 and 4,039,113, the disclosures of which are hereby incorporated by reference into the present specification. While pneumatic systems are preferred, other power operated means for effecting the cycle of operation of the fastener driving element may be utilized as, for example, electrical systems, internal combustion systems and the like.

In the pneumatic device shown, the piston is mounted within a cylinder for movement through successive cycles of operation, each of which includes a fastener driving stroke and a return stroke. The actuation of the piston through its fastener driving stroke is controlled by the actuating mechanism, generally indicated at 20. The actuating mechanism 20 includes a reciprocatively mounted depending valve actuating member 22 which controls the fluid pressure control system. Selective movement of actuating member 22 from a normal outwardly extending inoperative position into an inwardly extending operative position initiates the power operated means 18 to move through a fastener driving stroke. The device also includes the usual fastener magazine assembly, generally indicated at 24, for receiving a supply of fasteners and for feeding successive fasteners into the drive track in a position to be driven outwardly thereof into a workpiece during successive fastener driving strokes of the fastener driving element.

The actuating mechanism 20 also includes a contact trip element 26 having a lower portion reciprocatively mounted in cooperating relationship with the nosepiece of the housing adjacent the drive track, an intermediate portion extending rearwardly therefrom and having a horizontal locking surface 40 and an upper vertically extending portion 42 which, for purposes of the present application, may be considered a work contact responsive member. The contact trip element 26 is resiliently urged into a downward inoperative position by a spring (not shown) so that the lower end portion thereof extends beyond the discharge end of the drive track. The work contact responsive member 26 is movable from its normal inoperative position in response to the movement of the device 10 into cooperative engagement with a workpiece. The work contact responsive member 26 is also movable from its normal inoperative position in response to an upper portion of the housing 14 impacting a foreign object. Because the housing 14 is rigid, upon an impact with a rigid foreign object, movement of the housing will come to an abrupt stop. Meanwhile the work contact responsive member 26, which is not rigidly attached to the housing 14 in the vertical direction will continue to move upwardly towards and into the operative position under the impulsive forces created by the impact. Movement of the device away from the workpiece serves to effect movement of the work contact responsive member 26 from its operative position back into its inoperative position under the action of the spring.

The actuating mechanism 20 also includes a conventional trigger member 44 which is pivotally mounted from the housing 14 and a trigger lever 46 pivotally mounted at 48 with the trigger member 44. The trigger lever 46 is adapted to depress actuating member 22 into its operative position for actuating the piston and fastener driving element as described heretofore. The trigger lever 46 is free to pivot at 48 so that movement of the trigger member 44 alone into its operative position, without concomitant movement of work responsive member 26 into its operative position, will be ineffective to move actuating member 22 into its operative position.

Normal operation of the tool occurs when the work responsive member 26 is moved from the normal inoperative position into an operative position in response to the movement of the device 10 into cooperating engagement with a workpiece. This causes the upward movement of work contact responsive member 26 so that an upper portion thereof bears against trigger lever 46. With the work contact responsive member 26 in its operative position, in accordance with usual practice, movement of trigger member 44 from its inoperative position shown in FIG. 1 to its operative position in response to digital pressure by the operator will result in actuating member 22 being moved into the operative position so that a fastener will be discharged into the workpiece. It should be understood that the actuating mechanism 20 described provides means operatively associated with members 22, 26, 42, 44, 46 and 48 for (1) enabling movement of the trigger member 44 into its operative position when the work contact responsive member 26 is in its inoperative position without movement of the actuating member 22 into its operative position, (2) enabling movement of the trigger member 44 into its operative position when the work contact responsive member 26 is in its operative position to effect movement of the actuating member 22 into its operative position, and (3) enabling movement of the work contact responsive member 26 when the trigger member 44 is in its inoperative position without movement of the actuating member 22 into its operative position.

It will be further understood that in the event that the work contact responsive member 26 is prevented from movement from the inoperative position into the operative position, movement of the trigger member 44 will be rendered ineffective to actuate the piston and fastener driving element 18.

In accordance with the principles of the present invention, an actuation preventing mechanism for preventing an unwanted actuation of the power operated drive means is provided in the form of a contact trip lock-out mechanism 12. An arrangement of the contact trip lock-out mechanism 12 is illustrated in FIGS. 1–4. The contact trip lock-out mechanism is shown in the normal inoperative position in FIGS. 1–3 and in the operative position in FIG. 4. As best shown in FIGS. 1 and 2, the mechanism 12 includes an inverted L-shaped member 60 pivotally mounted to a guide member 62 on pin portion 64. Pins 66 mounted in holes 68 securely mount guide member 62 to housing 12. L-shaped member 60 has a generally vertical downwardly extending lock-out arm portion 70 disposed below pin portion 64. Lock-out arm portion 70 is laterally and vertically spaced from horizontal locking surface 40 when in the normal inoperative position. L-shaped member 70 also has a weighted portion 72 that is horizontally and laterally disposed from pin portion 64. The center of gravity of the L-shaped member 60 when Operatively mounted on the pin portion 64 is located in the weighted portion 72 which is disposed vertically above the horizontal locking surface 40.

The contact trip lock-out mechanism 12 further includes spring means in the form of a hairpin spring 74 for resiliently urging the L-shaped member 60 towards the normal inoperative position. L-shaped member 60 has a forward portion 76 of generally cylindrical shape and around which hairpin spring 74 is disposed and an angled section 78 into which one end of the hairpin spring 74 is in abutting engagement with. The other end of hairpin spring 74 is placed within hole 80 in guide member 62. In the inoperative position, one side of lock-out arm portion 70 is in abutting relation with first surface 82 to prevent movement there beyond under the bias of hairpin spring 74. L-shaped member is disposed between rearward surface 84 of the guide means 62 and forward surface 86 of the housing 14 so as to restrict longitudinal translational movement of the L-shaped member 60.

The weighted portion 72 also includes a cooperating abutment surface which is interengagable with second surface 88 of the guide member 62 when the L-shaped member 60 is brought into the operative position so as to prevent movement there beyond in reaction against the upward movement of work contact responsive member 26 due to inertial forces generated thereupon when the upper portion of the housing 14 impacts a foreign object. Lock-out arm portion 70 is formed with a downwardly facing angled surface 90 in its lowermost portion which is brought into abutting engagement with horizontal locking surface 40 when work contact responsive member moves toward the operative position in response to an impact. L-shaped member 60 has sufficient rigidity so as to prevent the upward movement of work contact responsive member 26 into the operative position when L-shaped member 60 is brought into abutting engagement with second surface 88 and horizontal surface 40 is brought into abutting engagement with angled surface 90.

In operation, as described above contact trip lock-out mechanism 12 is normally retained in the normal inoperative position under the bias of hairpin spring 74. In the event that an upper portion of housing 14 impacts a rigid foreign object, the inertial forces created will be generated on the L-shaped member 60 through its center of gravity and create a rotating torque on the L-shaped member about the pin portion 64 sufficient to overcome the hairpin spring 74 and move the L-shaped member from the inoperative position to the operation position whereby the sequence of movements is such that the work contact responsive member 26 is prevented from movement from its inoperative position into the operative position.

It can thus be seen that there has been provided an impulse actuated contact trip lock-out mechanism 12 which permits manual actuation of the actuating mechanism for utilization of the tool under normal operating conditions. The impulse actuated contact trip lock-out mechanism prevents accidental or inadvertent actuation of the manual actuating mechanism by preventing the movement of the actuation member 20 from its inoperative position to the operative position thereby preventing accidental discharge of the fasteners from the device.

It will thus be seen that the objects of this invention have been fully and effectively accomplished. It is realized, however, that the foregoing preferred specific embodiments have been shown and described for the purpose of illustrating the functional instructional principles of this invention subject to change without departure from such principles. Therefore, this invention includes all modifications encompassed within the spirit and scope of the following claims.

What is claimed is:

1. A fastener driving device comprising a housing having a handle portion enabling a user to manually operate said device in portable fashion and a drive portion disposed forwardly of said handle portion, power operated structure in said housing drive portion actuatable to be moved through successive operating cycles each of which includes a drive stroke and a return stroke, a nosepiece and magazine assembly carried by said housing including structure defining an elongated drive track and a feed track leading laterally into said drive track, a fastener driving element slidably mounted in said drive track and operatively connected with said power operated structure so as to drive a leading fastener fed into said drive track from said feed track outwardly of said drive track and into a workpiece during the drive stroke of said power operated structure, an actuating mechanism including a contact trip element mounted for movement adjacent the nosepiece for movement from an inoperative position to an operative position when said nosepiece is normally moved into engagement with a workpiece and a trigger member mounted on said housing adjacent said handle portion for movement by digital pressure from an inoperative position into an operative position, said actuating mechanism being operable to actuate said power operated structure to move through one operative cycle in response to the movement of said contact trip element and said trigger member into their respective operative positions, an actuation preventing mechanism constructed and arranged to be movable between (1) a normal inoperative position permitting actuation of said power operated structure, and (2) an operative position preventing an unwanted actuation of said power operated structure in response to an inadvertent impact of the housing with a foreign object during an upward manual movement of the housing while the operator is exerting digital pressure on the trigger member.

2. A fastener driving device as defined in claim 1, wherein said actuating mechanism also includes an actuating member carried by said housing for movement from a normal inoperative position into an operative position for selectively actuating said power operated structure to move through a fastener driving stroke.

3. A fastener driving device as defined in claim 2, wherein said actuating mechanism includes a linkage operatively associated with said contact trip element, said trigger member and said actuating member for (1) enabling movement of said trigger member into its operative position when said contact trip element is in its inoperative position without movement of said actuating member into its operative position, (2) enabling movement of said trigger member into its operative position when said contact trip element is in its operative position to effect movement of said actuating member into its operative position, and (3) enabling movement of said contact trip element when said trigger member is in its inoperative position without movement of said actuating member into its operative position, whereby, when said actuation preventing mechanism is in its normal inoperative position, said contact trip element is movable into its operative position to effect movement of said actuating member into its operative position and movable when said trigger member is in its inoperative position without movement of said actuating member into its operative position, and when said actuating preventing mechanism is in its operative position, said contact trip element is prevented from movement into said operative position from said inoperative position in response to impulse forces generated thereon when an upper portion of said housing impacts a foreign object thereby preventing an inadvertent and unwanted discharge of fasteners from said device.

4. A fastener driving device as defined in claim 3, wherein said actuation preventing mechanism includes an inverted L-shaped member pivotally mounted to said housing and having a generally vertically extending lock-out arm portion, and said contact trip element is mounted for movement through its operative cycle in a position laterally spaced from said lock-out arm portion when said actuation preventing mechanism is in its normal inoperative position.

5. A fastener driving device as defined in claim 4, wherein said L-shaped member includes a pivot hole and is mounted for pivotal movement by means including a pivot pin extending between opposed walls of said housing and said contact trip element includes a guide portion mounted for vertical translational movement within said housing.

6. A fastener driving device as defined in claim 5 including spring means for resiliently urging said L-shaped member toward said normal inoperative position and cooperating abutment surfaces on said L-shaped member and said housing interengageable when said L-shaped member is in said normal inoperative position to prevent movement there beyond under the bias of said spring means.

7. A fastener driving device as defined in claim 6, wherein said work contact responsive member includes locking surface means vertically and laterally spaced from said lock-out arm portion when said L-shaped member is in said normal inoperative position.

8. A fastener driving device as defined in claim 7, wherein said L-shaped member is operable for movement from said normal inoperative position to said operative position in response to said upper portion of said housing impacting a foreign object and impulsive forces generated by the impact cause said contact trip element to move from said inoperative position towards said operative position whereby the sequence of said movements is such that said locking-arm portion is brought into its operative position and into abutting engagement with said locking surface means so as to prevent said contact trip element from movement from said inoperative position into said operative positions.

9. A fastener driving device as defined in claim 8, wherein said L-shaped member has a weighted portion laterally disposed from said pivot pin and the center of gravity of said L-shaped member when operatively mounted on said pivot pin is in said weighted portion.

10. A fastener driving device as defined in claim 9, wherein said center of gravity of said weighted portion is disposed vertically above said locking surface means.

11. A fastener driving device as defined in claim 10, wherein said lock-out arm portion is formed with a downwardly facing angled surface in its lowermost portion.

12. A fastener driving device as defined in claim 11, wherein said opposed walls restrict the translational movement of said L-shaped member.

13. A fastener driving device as defined in claim 12 including cooperating abutment surfaces on said L-shaped member and said housing interengageable when said L-shaped member is in said operative position to prevent movement there beyond in response to inertial forces of said contact trip element thereon caused by said upper portion of said housing impacting a foreign object.

14. A fastener driving device as defined in claim 13, wherein the inertial forces caused by said upper portion of said housing impacting a foreign object and generated through said center of gravity create a rotating torque on said L-shaped member about said pivot pin sufficient to overcome said spring means and move said L-shaped member from said inoperative position to said operative position whereby the sequence of movements is such that said contact trip element is prevented from movement from said inoperative position into said operative position.

* * * * *